US010913580B2

(12) United States Patent
Browne

(10) Patent No.: US 10,913,580 B2
(45) Date of Patent: Feb. 9, 2021

(54) TAMPER-EVIDENT CONTAINER CAP ASSEMBLY

(71) Applicant: GE Healthcare AS, Oslo (NO)

(72) Inventor: Martin M. Browne, Oslo (NO)

(73) Assignee: GE HEALTHCARE AS, Oslo (NO)

( * ) Notice: Subject to any disclaimer, the term of this patent is extended or adjusted under 35 U.S.C. 154(b) by 624 days.

(21) Appl. No.: 14/649,855

(22) PCT Filed: Dec. 27, 2013

(86) PCT No.: PCT/US2013/077909
§ 371 (c)(1),
(2) Date: Jun. 4, 2015

(87) PCT Pub. No.: WO2014/106002
PCT Pub. Date: Jul. 3, 2014

(65) Prior Publication Data

US 2015/0298869 A1 Oct. 22, 2015

Related U.S. Application Data

(60) Provisional application No. 61/746,204, filed on Dec. 27, 2012.

(51) Int. Cl.
*B65D 41/38* (2006.01)
*B65D 41/32* (2006.01)
(Continued)

(52) U.S. Cl.
CPC ..... *B65D 41/32* (2013.01); *B65D 41/3447* (2013.01); *B65D 41/40* (2013.01); *B65D 47/103* (2013.01)

(58) Field of Classification Search
CPC .... B65D 2101/0046; B65D 2101/0061; B65D 41/3409; B65D 41/3428; B65D 41/3447;
(Continued)

(56) References Cited

U.S. PATENT DOCUMENTS 4,278,180 A 7/1981 Willis
4,448,318 A * 5/1984 Lowe ..... B65D 41/3409 215/252
(Continued)

FOREIGN PATENT DOCUMENTS

AU 480881 B2 9/1975
DE 3606571 A1 9/1987
(Continued)

OTHER PUBLICATIONS

JP_2009220834_translation.pdf.*
(Continued)

*Primary Examiner* — Allan D Stevens
(74) *Attorney, Agent, or Firm* — Jeff B. Vockrodt; Culhane Meadows, PLLC

(57) ABSTRACT

A container cap assembly provides a tamper-evident component for detecting cap integrity on a container includes one or more elongate bridges connecting a tamper-evident ring to a cap. The cap assembly also provides radially-extending links on the cap and the tamper-evident ring to help protect the integrity of the bridges as the cap assembly is applied to a container.

4 Claims, 8 Drawing Sheets

(51) Int. Cl.
*B65D 41/40* (2006.01)
*B65D 41/34* (2006.01)
*B65D 47/10* (2006.01)

(58) Field of Classification Search
CPC ..... B65D 41/3466; B65D 41/3414; B65D 41/3433; B65D 41/3471; B65D 41/3452; B65D 2101/0038; B65D 2101/003; B65D 2101/0076; B65D 55/06; B65D 55/026; B65D 41/34
USPC ..... 215/252
See application file for complete search history.

(56) References Cited

U.S. PATENT DOCUMENTS 4,550,844 A 11/1985 Lininger
4,577,770 A * 3/1986 Wright ..... B65D 41/3452 215/252
4,856,665 A 8/1989 Dutt et al.
5,005,720 A 4/1991 Heilman
5,246,125 A 9/1993 Julian
5,547,092 A * 8/1996 Thompson ..... B65D 41/3447 215/252
5,992,657 A 11/1999 Friedman
2005/0173435 A1 8/2005 Wellman et al.

FOREIGN PATENT DOCUMENTS

EP 0366198 A1 5/1990
EP 1122185 A2 8/2001
EP 1122185 A3 11/2003
JP H06-345106 A 12/1994
JP 2009-220834 A 10/2009

OTHER PUBLICATIONS

European Search Report regarding EP Application No. 13868359.4, dated Jul. 5, 2016, 7 pages.
International Search Report and Written Opinion for PCT/US2013/077909, dated May 7, 2014, 10 pages.
Notification of Reasons for Refusal issued in connection with corresponding JP Application No. 2015-550781 dated Sep. 19, 2017.

* cited by examiner

TAMPER-EVIDENT CONTAINER CAP ASSEMBLY

CROSS-REFERENCE TO RELATED APPLICATIONS

This application is a filing under 35 U.S.C. 371 of international application number PCT/US2013/077909, filed Dec. 27, 2013, which claims priority to U.S. application No. 61/746,204, filed Dec. 27, 2012, the entire disclosures of each of which are hereby incorporated by reference.

FIELD OF THE INVENTION

The present invention relates to the field of container caps. More specifically, the present invention is directed to a tamper-evident container cap assembly.

BACKGROUND OF THE INVENTION

In the medical field, sterile fluids, such as medicaments, pharmaceuticals, sterile saline solution and so on are frequently required for the treatment of patients. Such sterile fluids are normally supplied in containers made of plastic or glass, which is chemically inert and highly unlikely to contaminate or otherwise adulterate the sterile fluid.

The containers are normally closed by a rubber stopper inserted into the mouth of the container. The stopper is designed so that it can be pierced by a needle of a hypodermic syringe, an infusion spike of an infusion set, or the like, to allow the contents of the container to be withdrawn. The stopper may also be removed to allow the contents of the bottle to be poured out.

In order to hold the stopper in place, a cap assembly is often threaded over the stopper and the neck of the bottle. In order to gain access to the stopper, either to pierce it or remove it, the cap is either partially torn away or totally removed from the container neck. The art has seen various designs for a container cap assembly which may be secured to a container neck and thereby prevent exposure of the stopper until use of the fluid.

FIG. 1 shows a container cap assembly 10 of the prior art. Cap assembly 10 includes a cap 12 having an elongated cylindrical wall 14 having a planar end surface 16 spanning one end. Cylindrical wall 14 supports an internally-extending helical thread (not shown) for screwing onto a mating thread on the neck of a container. Planar end surface 16 includes a frangible lid 18 which when removed from cap 12 will expose a septum (not shown) supported between the cap 12 and the neck (not shown) of the container. Lid 18 further includes upstanding posts 20 which support a pull ring 22 to assist in the removal of lid 18. A castellation ring 24 attaches to cap 12, providing a number of castellations 27 which extend at least as high as the pull ring 22 to protect against accidental engagement prior to removing lid 18. An indicia 25 is provided on lid 18 to indicate the direction for pulling the pull ring 22 to remove the lid 18 and to ease separation of the lid 18 from the remainder of cap 12. Cap 12 further includes a number of radially-spaced outwardly projecting fittings 26 for engagement by user fingers when removing the cap 12 from the container (not shown) so as to fully expose or remove the septum (not shown) closing the container.

The cap 12 of FIG. 1 is also provided with a tamper-evident ring 30 which is designed to remain with the container after cap assembly 10 has been removed. Ring 30 defines a number of lug apertures 32 which allow a snap-fit to cooperating projecting lugs (not shown) on the neck of the container (not shown). The projecting lugs (not shown) of the container (not shown) ensure that ring 30 remains in place as cap assembly 10 is rotated off of the container. Such tamper-evident rings are widely in use on containers ranging from pharmaceutical liquid containers to soft drink bottles. A number of frangible bridge elements 34 connect cap 12 to ring 30. Such bridge elements 34 are typically made to be quite small and thin so that they structurally fail upon application of an opening force to the cap, that is, when the cap is to be removed from the container or bottle. However, if the bridge elements are too small, it is difficult to determine whether they are still intact. With small bridges, it may be possible to remove the cap assembly 10 and then apply an adhesive to the broken bridges to re-secure the cap assembly 10 to the tamper-evident ring 30 without being obvious upon a visual inspection. Moreover, if the bridge is too week, the cap assembly 10 may fail quality control by breaking during the application of the cap assembly 10 to a container neck. Such failures may result in rejections, disturbances to logistics/planning, cost for retesting, cost for vendor complaints, line capping failures, line stoppage and high reject rates at finished product inspection. Additionally, if the bridge elements 34 are made too large, it is possible that they could withstand the opening force such that the tamper-evident ring 30 will be removed from the container with the cap assembly 10. In a worst case scenario, it could be possible for the container cap assembly 10 and/or both the cap 12 and the tamper-evident ring 30 to be removed from the container so as to expose the contents to withdrawal or contamination, ie, tampering, and then placed back on the container without showing any obvious sign that the cap had been removed from the container.

The art therefor lacks a cap assembly which provides high bridge integrity as well as easy visual verification of bridge integrity.

SUMMARY OF THE INVENTION

In view of the needs of the art, the present invention provides a container cap assembly with improved tamper-evident features.

In one aspect, the present invention provides an improved tamper-evident bridge extending between a cap and a tamper-evident ring.

In another aspect, the present invention provides radially-extending cooperative links between the cap and the tamper-evident ring which prevent destructive deflection of the bridges as the cap assembly is secured to a container neck while still allowing the bridges to take the full force when removing the cap from the container and tamper-evident ring.

In yet another aspect of the invention, there is provided a package comprising a container with a neck defining a mouth, a stopper inserted into or over the mouth, and a cap of the present invention overlying the stopper and neck of the container.

Desirably, the container and the cap have complementary helical threads to provide a simple and effective way to help secure the cap on the container.

It is further preferred that the cap be provided with a tamper-evident feature, to reduce the risk of fluid being administered from a package which has been opened and then reclosed. Such opening and reclosing can result in the fluid losing its sterility, or in adulteration or contamination of the fluid in some form. One suitable form of tamper-evident feature is a member removably attached to the cap, which must be detached from the cap before the cap can be removed. The absence of the member is then a sign that the package has been opened at some time, and should not be used.

In still yet another embodiment, the cap includes a removable portion which can provide access to the stopper while the remainder of the cap is maintained on the container.

BRIEF DESCRIPTION OF THE DRAWINGS

Preferred embodiments of the invention will now be described by way of example only and with reference to the accompanying drawings, in which.

DETAILED DESCRIPTION OF THE PREFERRED EMBODIMENT

Figure 9:
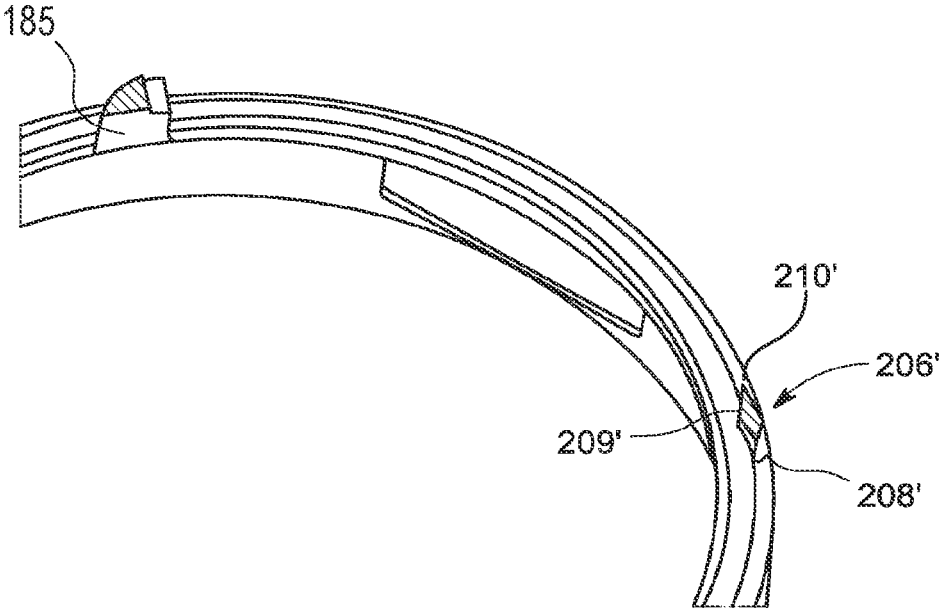
FIG. 9 depicts a cross-sectional view of a tamper-evident bridge of the present invention having a two thin edges proximate the ring of an assembly.
Figure 10:
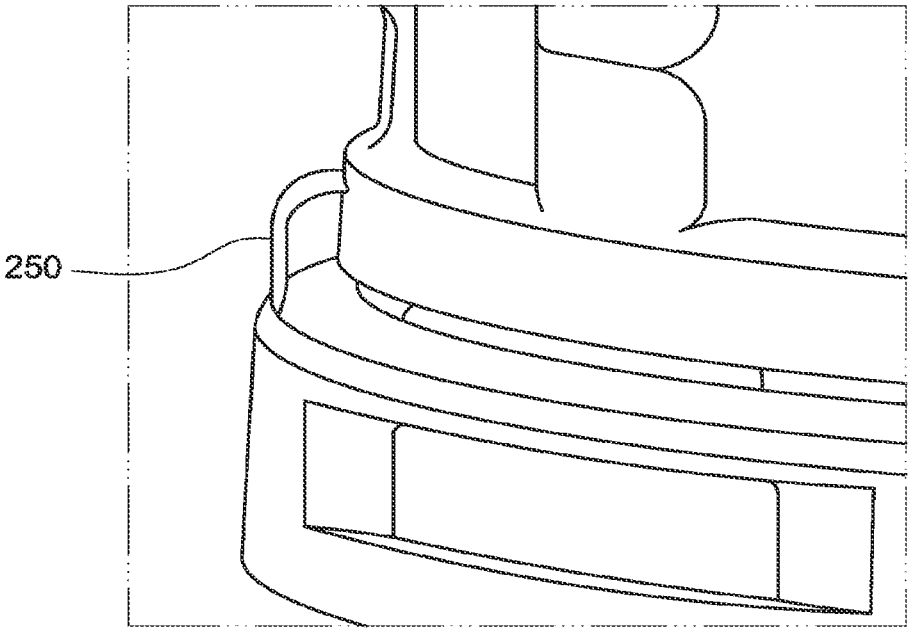
FIG. 10 depicts an oblique view of a thin tamper-evident bridge of the present invention.
Figure 11:
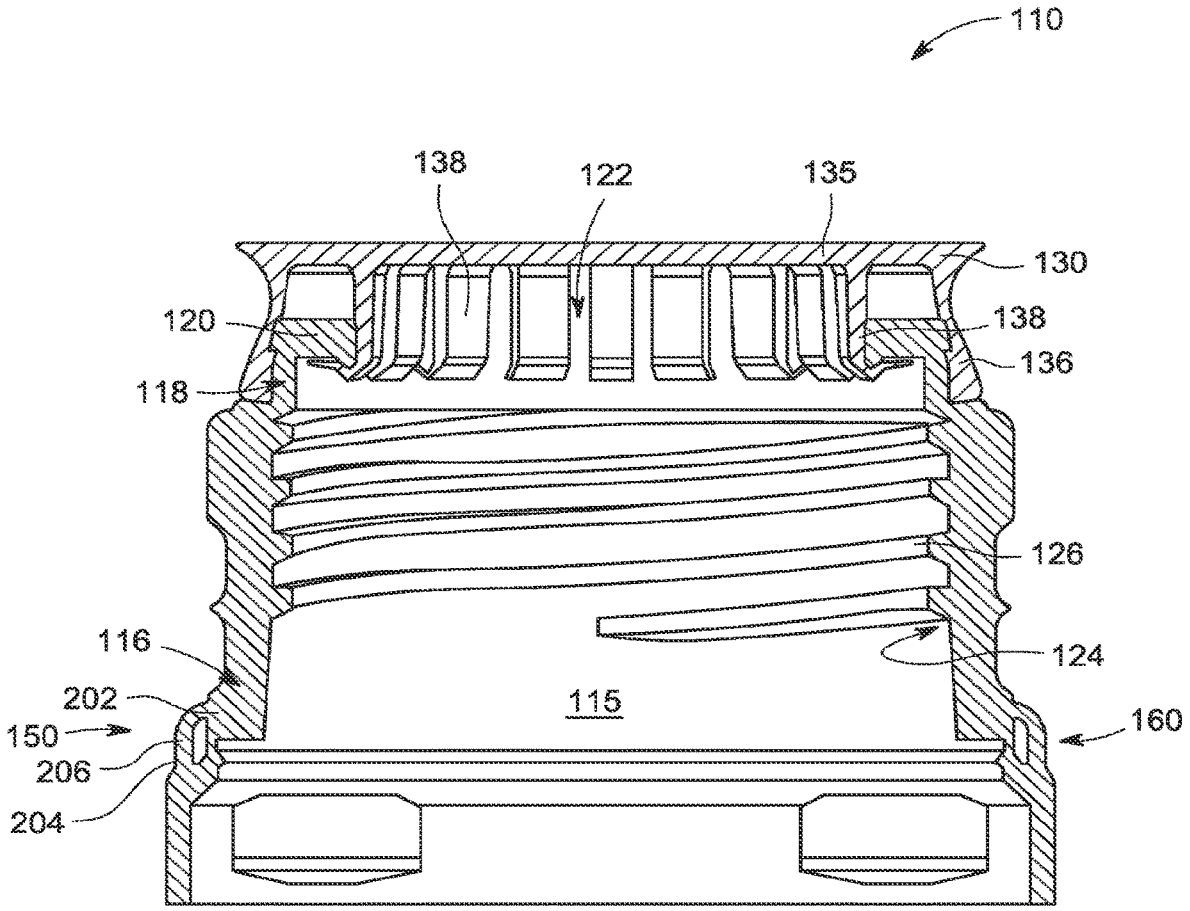
FIG. 11 depicts a cross-sectional view of a cap assembly of the present invention along line 11-11 of FIG. 2.

Referring to FIGS. 2-12, the present invention provides a tamper-evident container cap assembly 110. Cap assembly 110 includes a cap 112 having an elongate cylindrical wall 114 extending between opposed first end 116 and second end 118. First end 116 defines a cap mouth 115 (FIG. 11) for receiving the neck of a container to which cap assembly 110 is connected. Second end 118 includes an inwardly-extending annular rim 120, as shown in FIG. 11.

Figure 1:
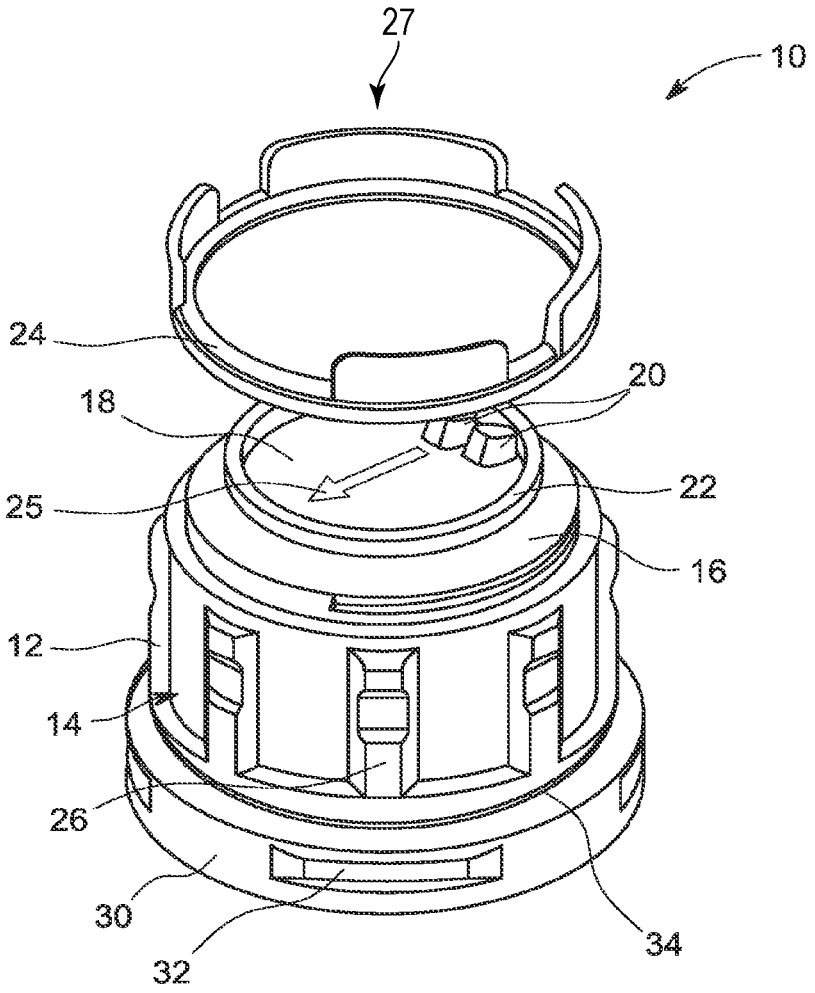
FIG. 1 PRIOR ART
FIG. 1 depicts a cap assembly of the prior art.

Annular rim 120 defines a cap aperture 122 formed to extend in overlying registry with a stopper (not shown) placed in or across the open neck of the container which cap assembly 110 is attached. Cap 112 includes an inner cylindrical surface 124 supporting an internally-extending helical thread 126 for screwing onto a mating thread on the neck of a container. As shown, cap assembly 110 may include a removable top 130 which spans across the second end 118 of the cap 112, although the manner of protecting the aperture in registry with the container stopper is not essential to the present invention. For example, it is also contemplated that cap 112 may, instead of removable top 130, include a removable lid 18 frangibly connected to the annular rim 120 as depicted for the cap assembly 10 of FIG. 1. Cap 112 further includes a number of radially-spaced outwardly projecting fittings 132 (FIG. 2) for engagement by a user's fingers when removing the cap 112 from the container so as to fully expose or remove the septum (not shown) closing the container. Fittings 132 further include indents 134 for engagement by an injector.

Cap assembly 110 is also provided with a tamper-evident ring 140 which is designed to remain with the container after cap 112 has been removed. Ring 140 includes a ring body 141 which defines a number of lug apertures 142 which allow a snap-fit to cooperating projecting lugs on the neck of the container. The projecting lugs of the container ensure that ring 140 remains in place as cap 112 is rotated off of the container and separated from ring 140.

Cap assembly 110 includes first and second elongate frangible bridge elements 150 and 160 extending from cap 112 to ring 140. Desirably, bridge elements 150 and 160 are diametrically opposed across cap 112 from each other. While the present invention contemplates that only a single frangible element of the design of bridge element 150 or 160 may be employed in the cap assembly 110, also contemplated is providing at least two such bridge elements will provide a more tamper-evident cap assembly 110. Cap assembly 110 further includes first radially-extending cap link 170 and second radially-extending cap link (not shown, opposite) while ring 140 includes first radially-extending ring link 172 and second radially-extending ring link (not shown, opposite). Cap link 170 and ring link 172 are positioned in close proximity and in facing opposition across a gap 174. Similarly, on the opposite side, the second cap link (not shown, opposite) and second ring link (not shown, opposite) are positioned in close proximity and in facing opposition across a radially-spaced gap (not shown, opposite). Desirably, the first cap link 170 and second cap link (not shown, opposite) are diametrically opposed across cap 112 from each other while the first ring link 172 and second ring link (not shown, opposite) are diametrically opposed across ring 140 from each other. The first ring link 172 and the second ring link (not shown, opposite) are positioned to be radially-outward of first end 116 of cap wall 114 so that cap wall 114 will pass clear radially-inward of first ring link portion 172 and second ring link (not shown, opposite) as cap 112 is removed from ring 140.

Figure 3:
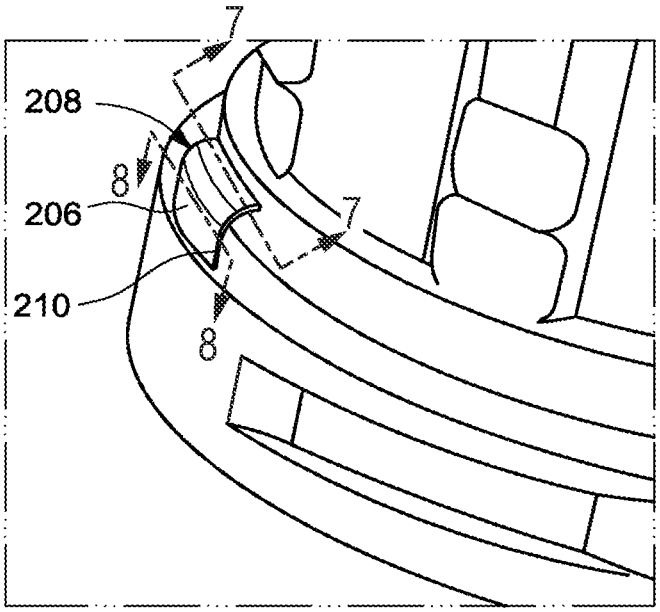
FIG. 3 depicts an oblique view of the tamper-evident bridge of the present invention.

Bridge elements 150 and 160 are shown having desirably identical designs, so bridge element 150 will be described in further detail. As shown in FIG. 11, bridge element 150 includes a first end 202 connected to the cylindrical wall 116 of cap 112 and a second opposing end 204 connected to ring 140. Bridge body 206 may extend substantially normally from cylindrical wall 114 of cap 112 and include a bend to extend to ring 140. Bridge element 150 includes a substantially planar bridge body 206 having opposed elongate bridge edges 208 and 210 extending between ends 202 and 204, as shown in FIG. 3. Edges 208 and 210 may be shaped to be thin sharp edges, arcuate or planar faces, or may transition from one shape to the other along their length. Bridge body 206 includes an asymmetric cross-section proximate to at least one of first and second ends 202 and 204. The present invention contemplates that the term 'asymmetrical' indicates non-uniformity about at least one axis. Desirably, bridge body 206 includes an asymmetric cross-section at both ends 202 and 204. Desirably still, the present invention contemplates that each end 202 and 204 of bridge body 206 is thinner at opposing edges 208 and 210, respectively.

Figure 4:
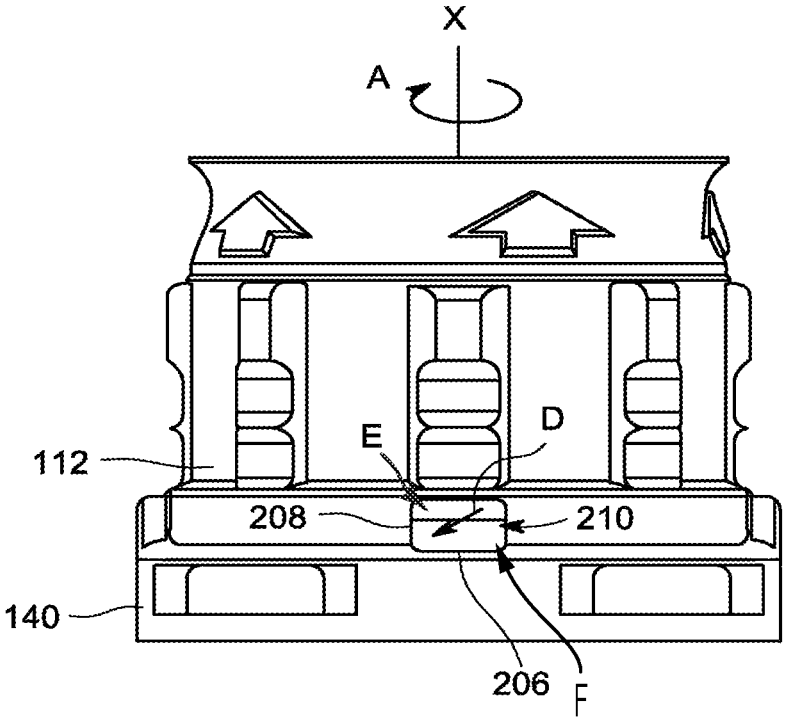
FIG. 4 depicts a side view of a cap assembly of FIG. 2.
Figure 7:
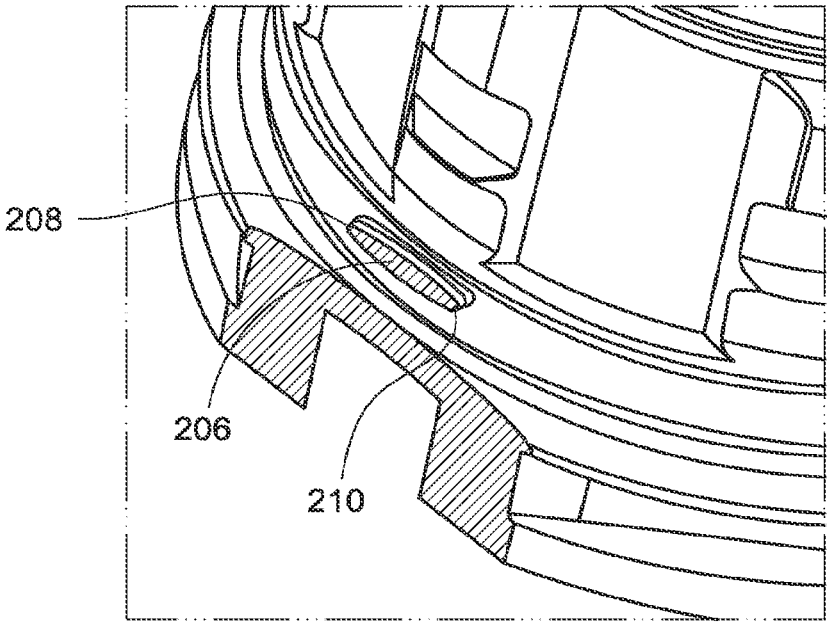
FIG. 7 depicts an enlarged cross-sectional view of a tamper-evident bridge of the present invention proximate to the cap of an assembly along line 7-7 of FIG. 3.
Figure 8:
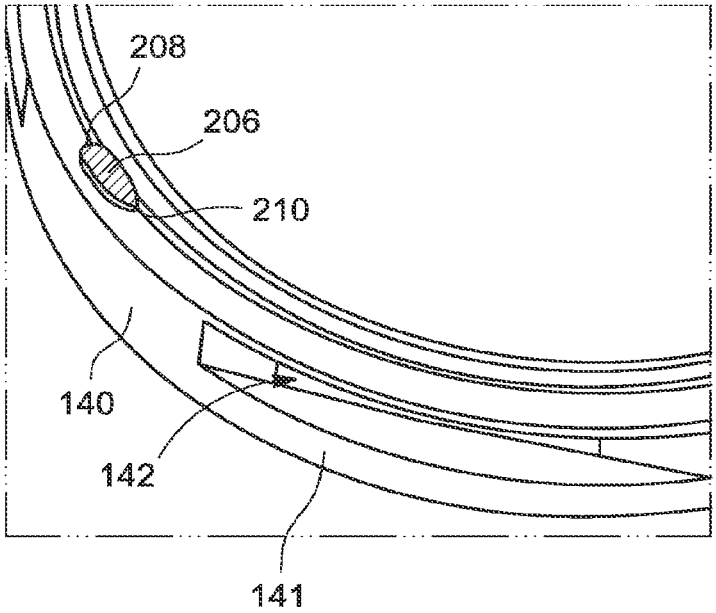
FIG. 8 depicts an enlarged cross-sectional view of the tamper-evident bridge of the present invention proximate to the ring of an assembly along line 8-8 of FIG. 3.

With particular reference to FIGS. 4, 7 and 8, bridge body 206 is thinner at a portion of edges 208 and 210 which experience tension and thicker at the portion of edges 208 and 210 which experience compression during application of a rotational force to remove cap 112 from ring 140.

Tearing of bridge body 206 at these thinner portions will also be aided by torsional forces caused by the relative rotation of cap 112 about ring 140. That is, the edge of the bridge proximate cap 112 that faces the movement of cap 112 as it is removed from a container is desirably thinner than opposed edge of the bridge at cap 112. Similarly, the edge 210 of bridge proximate ring 140 which faces the direction of rotation of cap 112 as it is removed from the container is desirably thicker than the opposed edge 208 of bridge proximate ring 140. As shown in FIG. 4, when cap 112 is threaded to be removed by rotating clockwise about longitudinal axis X, as viewed from above cap 112 and depicted by arrow A, first end of 202 of bridge body 206 is formed so that edge 208 proximate cap 112 is thinner than edge 210 proximate cap 112 while second end 204 of bridge body 206 is formed so that edge 210 is thinner than edge 208 proximate ring 140. The relative shaping of bridge body 206 may be reversed for a cap assembly formed to be rotated in an opposite direction in order to remove the cap 112 from the ring 140.

It will be appreciated that the shaping of bridge body 206 additionally provides more strength at the edge portions of the bridge which experience tension as cap assembly 110 is threaded, or rotated, onto the neck of a container, until ring 140 deflects over the lugs of the container and the lugs extend through the lug apertures 142, allowing ring 140 to relax against the container neck.

Figure 5:
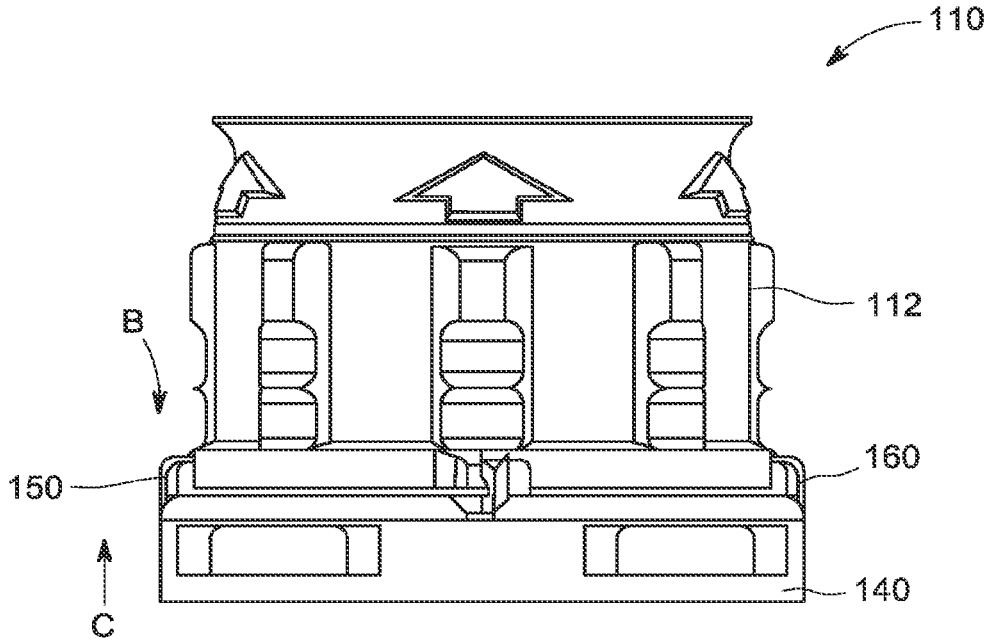
FIG. 5 depicts a front view of the cap assembly of FIG. 2.

Additionally, the length and shape of bridge body 206 allows for vertical movement during application of cap assembly 110 to a container without failing. As shown in FIG. 5, bridge body desirably allows deflection so that cap 112 is able to rest against ring 140 during attachment to a container without causing the bridge body to begin failing. This vertical movement is depicted by arrows B and C in FIG. 5.

Cap 112 and ring 140 are desirably formed from a polymer, such as polypropylene, by injection molding. When moulding the cap assembly 110 the plastic flows where the cross section is largest (designated along arrow D in FIG. 4). When moulding polypropylene, where the plastic flows through small cross sections one will get what is called a living hinge. To avoid this, the design is chosen so that the corners E & F where relative weakness is desired are very narrow and where we want strength are wide (start and end of arrow D). The sections of bridge body 206 which are placed in tension when unscrewing cap 112 will fill late and thereby avoid forming a living hinge. The sections that are wanted strong (at the ends of arrow D) will be stronger. The stronger corners are under greater tension stress during cap application.

The design of the bridges of the present invention provide easy visual confirmation of their integrity. When broken, after cap 112 removal, these relatively wide and thin bridges will have been stretched to failure, making them very difficult to make look intact again.

An alternative embodiment of the present invention also provides bridges 250 which are uniformly long, flat and thin, as depicted in FIG. 10. Alternatively, as shown in FIG. 9, the present invention contemplates that bridge body 206' includes a cross-section that is thinner at each edge 208' and 210' than it is at its central portion 209'.

While bridges 250 of FIG. 10 and bridge body 206' of FIG. 9 do not incorporate the asymmetrical structure of bridges 150 and 160, their relative width provides easy identification of tampering with cap assembly as each edge will be susceptible to tearing. Additionally, bridge body 206' is further contemplated to be asymmetrical by having a non-uniform cross-section along its entire length, such that while the ends are symmetrically thin at each edge as compared to the center portion, the edges may be thicker at a location midway along the length of the bridge body 206'.

Figure 2:
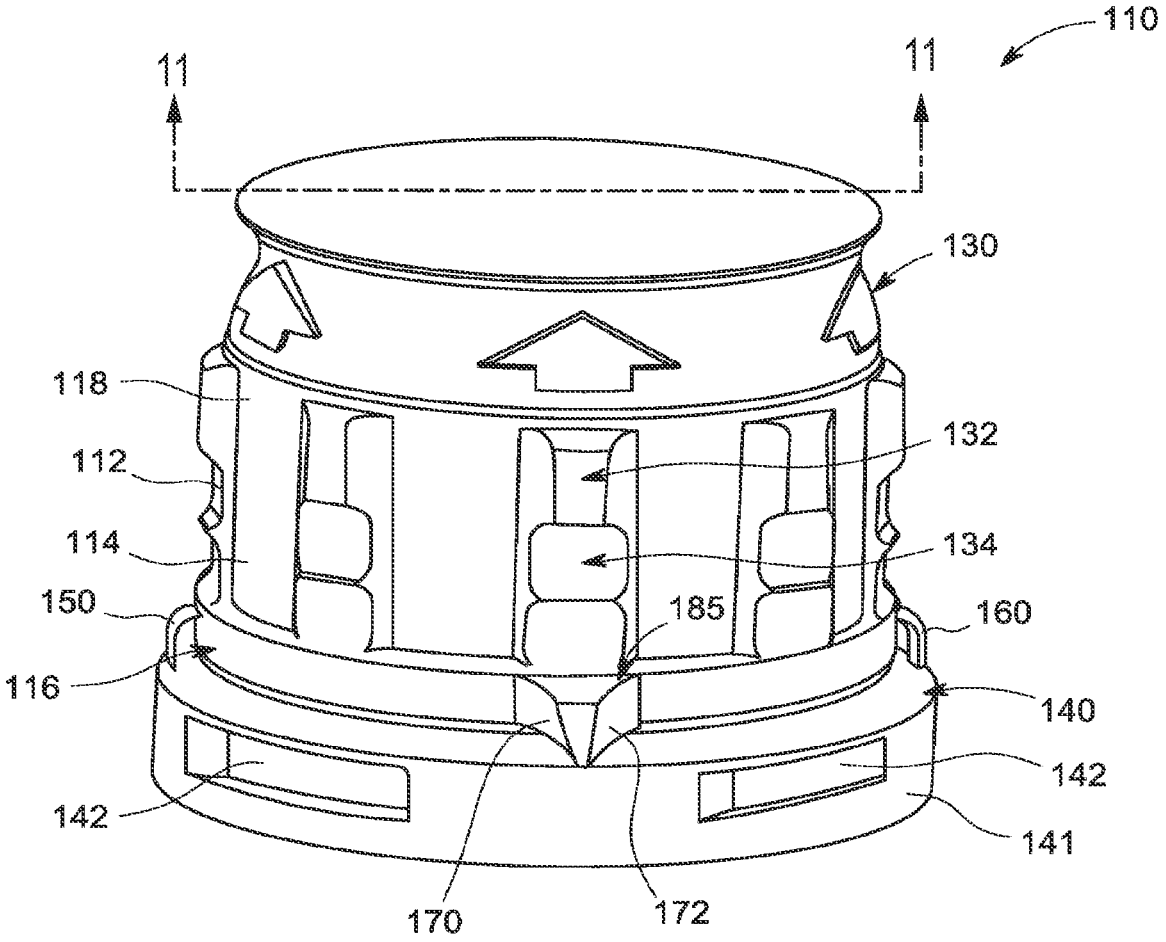
FIG. 2 depicts a container cap assembly of the present invention.
Figure 6:
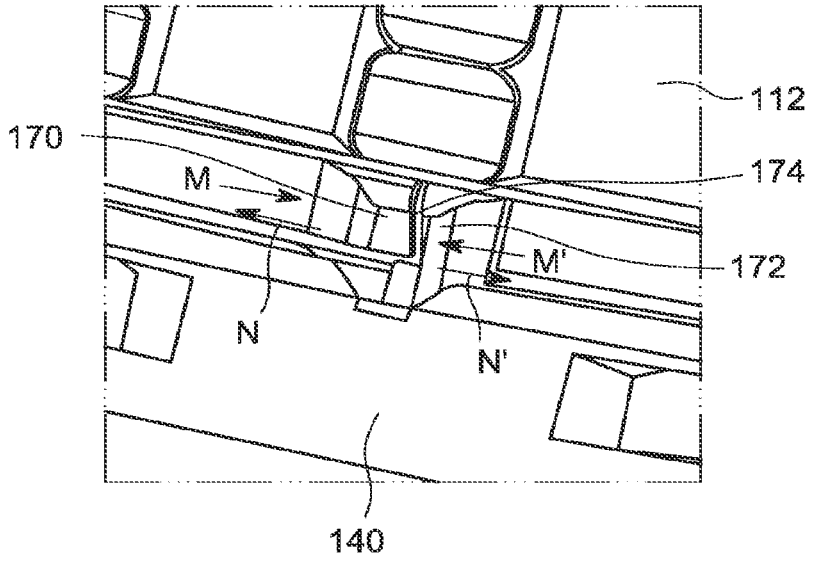
FIG. 6 depicts a coopering cap link and ring link of the cap assembly of FIG. 2.

The radially extending first cap link 170 and second cap link (not shown, opposite) and first ring link 172 and second ring link (not shown, opposite) cooperate to prevent a failure load being applied to the bridges while attaching or connecting the cap 112 to a container. In an undeflected orientation, first cap link 170 and second cap link (not shown, opposite) of cap 112 and first ring link 172 and second ring link (not shown, opposite) of ring 140 are spaced apart less than the maximum deflection allowed by bridges 150 and 160 before tearing of the bridges begins. The spacing of the cap links from the ring links is further contemplated to also take into account any deformation at the links which could allow further deflection of the bridges, all to ensure that the bridges do not fail during application of the cap assembly to a container. As shown in FIG. 6, first cap link 170 and second cap link (not shown, opposite) are positioned to extend to the side of the first ring link 172 and second ring link (now shown), respectively, facing the direction cap 112 is turned when separating cap 112 from tamper-evident ring 140. That is, as cap 112 is rotated to separate from ring 140, first cap link 170 and second cap link (not shown, opposite) will be drawn away from first ring link 172 and second ring link (not shown, opposite), respectively. As shown in FIGS. 2, 6 and 9, first ring link 172 and second ring link (not shown, opposite) are spaced radially-outwardly across a gap 185 from first end 116 of wall 114 of cap 112, so as to not interfere with the rotation of cap 112 when being removed from ring 140.

FIG. 6 further depicts arrows M and M' which depict the relative displacement of the first cap link 170 and second cap link (not shown, opposite) towards the first ring link 172 and second ring link (not shown, opposite) during application of cap assembly 110 to a container, in a position while the cap 112 is being screwed on. Arrows N and N' depict the relative displacement of the first cap link 170 and second cap link (not shown, opposite) away from the first ring link 172 and second ring link (not shown, opposite) as cap 112 is removed from the container and ring 140. The gap 174 between the opposed links on the cap 112 and the ring 140 can close to nothing as cap 112 is screwed onto the container neck. The rotational deflection of the cap links towards the ring links allows the two sets of links to engage each other and thus take any additional load from the bridges. The gap 174 between the links is designed to be less than the maximum deflection that the bridges may experience before starting to fail. As cap 112 is removed from the container and the ring 140, the cooperating links will be free from each other so that all stress is focused upon the two tamper-evident bridges 150 and 160. In the embodiments shown in FIGS. 2-10, cap 112 is threaded so as to rotate clockwise when being removed from a container. The present invention further contemplates that when the threading is reversed from what is shown in FIGS. 2-10 that the relative positioning of the cap links and ring links would also be reversed so that the cap links are able to move away from their respective ring link when removing cap 112 from a container. It is further contemplated that the links of the present invention may also be designed to improve the grip on the capping machine to help prevent slipping of the chuck during cap application.

Figure 12:
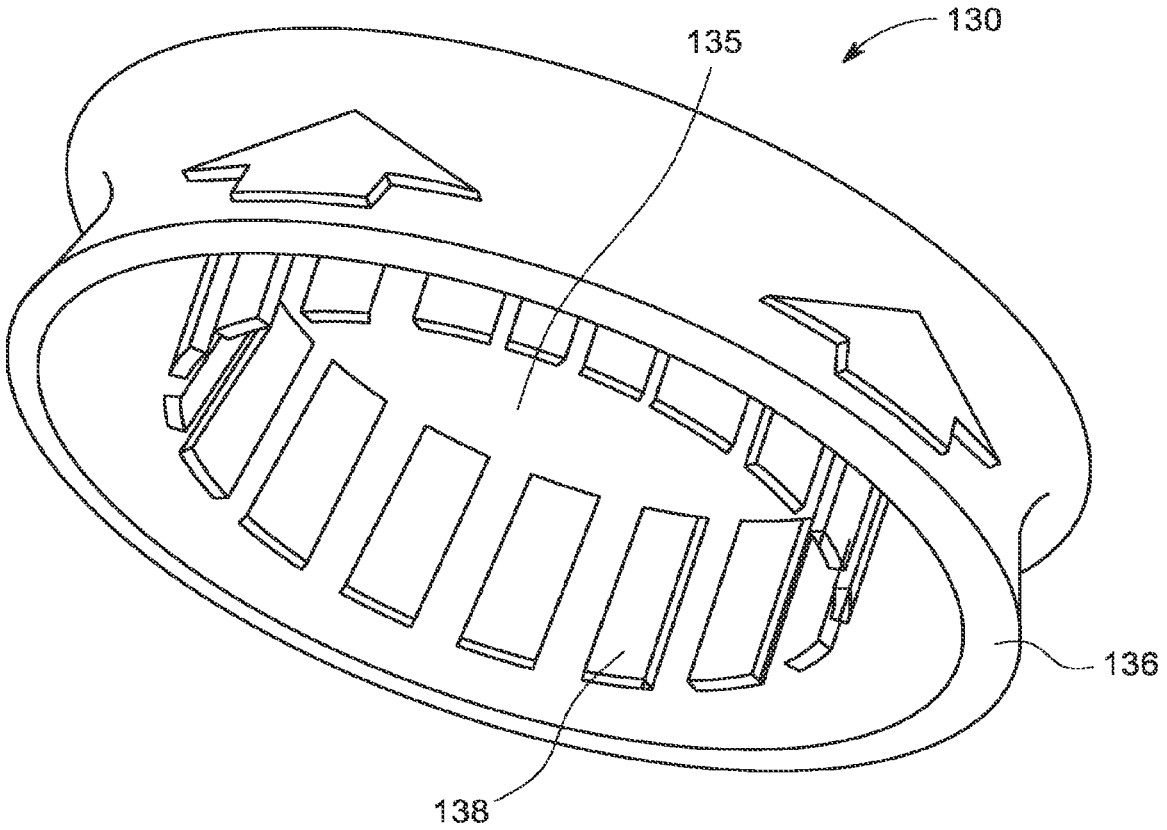
FIG. 12 depicts a perspective view from below of a flip-top of depicted cap in FIG. 2.

With particular reference to FIGS. 11 and 12, the removable top 130 includes a perimetrical annular outer wall 136 with a planar top wall 135 spanning across the upper end thereof. Removable top 130 is substantially as described in the present assignee's copending application Ser. No. 14/345,696, entitled "Package," which issued as U.S. Pat. No. 9,815,601 B2. Top 130 includes a number of depending legs 138 which are originally provided extending substantially normal from top wall 135 so as to extend into aperture 122. During assembly, legs 138 will be bent and heat-fixed about annular rim 120 of cap 112 so as to prevent tampering.

With a cap assembly of the present invention, the container to which it is connected may be opened in a number of ways. The removable portion of cap assembly can be removed to gain access to the stopper, whilst leaving the stopper in place. The stopper can then be pierced by a hypodermic needle or similar. Alternatively, the entire cap 112 may be removed (which will stress the bridges connecting the cap to the tamper-evident ring to failure), which then allows complete access to the entire stopper. Complete access to the stopper may be useful if, for example, an infusion spike which is wider than the removable portion of the cap is to be used. As a further alternative, the entire cap 112 and the stopper can be removed, to enable pouring out the contents or the insertion of a quill or straw to load an autoinjector.

While the particular embodiment of the present invention has been shown and described, it will be obvious to those skilled in the art that changes and modifications may be made without departing from the teachings of the invention. The matter set forth in the foregoing description and accompanying drawings is offered by way of illustration only and not as a limitation. The actual scope of the invention is intended to be defined in the following claims when viewed in their proper perspective based on the prior art.

What is claimed is:

1. A container cap assembly for connection to a neck of a container, said assembly comprising:

a cap, having a cylindrical wall said cylindrical wall including a cylindrical outer surface and a cylindrical inner surface, said inner surface supporting a helical thread thereon for cooperatively engaging a mating helical element of a container neck so as to allow said cap to be screwed onto said container neck;

a tamper-evident ring including an annular ring body, said ring body defining one or more lug apertures to engage cooperating lugs on the neck of the container;

at least one bridge element connecting said cap to said ring, said at least one bridge element having a first end connected to said cylindrical wall of said cap and a second end connected to said ring;

wherein said at least one bridge element includes a bridge body having opposed elongated bridge edges extending between said first and second ends and with an asymmetric cross-section proximate to at least one of said first or second ends; and wherein each end of said bridge body is thinner at a portion of each edge experiencing tension during application of a rotational force to remove said cap from said ring than at a portion of said each edge experiencing compression during application of said rotational force, wherein said bridge body comprises a curved sheet that extends outward from said cylindrical wall of said cap and bends to extend to the ring, the bridge body permitting vertical movement that allows the cap to contact the ring during application of the cap assembly without failing.

2. The container cap assembly of claim 1, wherein in an undeflected orientation, a cap link is spaced apart from a ring link less than a maximum deflection allowed by said at least one bridge element before tearing of the at least one bridge element begins.

3. The container cap assembly of claim 1, wherein said cap includes an upper surface spanning said cylindrical wall, said upper surface defining a cap aperture to be positioned in registry with a septum of the container on which said cap assembly is attached.

4. The container cap assembly of claim 3, wherein said upper surface further includes a removable top which spans said cap aperture, wherein said top is removable from said upper surface so as to expose said cap aperture.

* * * * *